US006259045B1

(12) United States Patent
Imai

(10) Patent No.: US 6,259,045 B1
(45) Date of Patent: Jul. 10, 2001

(54) KEYBUTTON-EQUIPPED DEVICE

(75) Inventor: Fumihito Imai, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/561,519

(22) Filed: Apr. 28, 2000

(30) Foreign Application Priority Data

Apr. 30, 1999 (JP) ..... 11-123685

(51) Int. Cl.[7] ..... H01H 9/26
(52) U.S. Cl. ..... 200/5 A; 200/512
(58) Field of Search ..... 200/5 A, 512–517, 200/293, 308, 310

(56) References Cited

U.S. PATENT DOCUMENTS 4,022,993 * 5/1977 Shattuck ..... 200/5 A
4,302,648 * 11/1981 Sado et al. ..... 200/159 B
4,320,268 * 3/1982 Brown ..... 200/5 A
4,365,120 * 12/1982 Pounds ..... 200/5 A
4,463,234 * 7/1984 Bennewitz ..... 200/159 B
4,598,181 * 7/1986 Selby ..... 200/5 A
5,270,507 * 12/1993 Nakamura et al. ..... 200/511
5,669,486 * 9/1997 Shima ..... 200/314
5,717,176 * 2/1998 Dahlstrom ..... 200/1 B
5,934,454 * 8/1999 Burleson et al. ..... 200/343
6,148,183 * 11/2000 Higdon et al. ..... 455/90

FOREIGN PATENT DOCUMENTS 5-16571 3/1993 (JP) .
8-148054 6/1996 (JP) .

* cited by examiner

*Primary Examiner*—Michael L. Gellner
*Assistant Examiner*—Nhung Nguyen
(74) *Attorney, Agent, or Firm*—Ostrolenk, Faber, Gerb & Soffen, LLP

(57) ABSTRACT

Disclosed is a keybutton-equipped device which has: a board at a predetermined position on which a predetermined number of sensitive element (e.g., a sensor and switch) at a predetermined position is provided; a case in which the board is mounted and a predetermined number of hole is formed at a position corresponding to the sensitive element on the board; and a keypad which is of stretchy material (e.g., rubber and plastic) and is formed like a tubular body to cover and tighten the case. The keypad has a predetermined number of keybutton that is formed on the outer surface of the tubular body and at a position corresponding to the sensitive element on the board and gives an impulse (e.g., a physical impulse such as pressure, voltage, current, static electricity and magnetic force) to the sensitive element on the board through the hole in the case when it is pressed down.

13 Claims, 7 Drawing Sheets

KEYBUTTON-EQUIPPED DEVICE

FIELD OF THE INVENTION

This invention relates to a keybutton-equipped device such as a cellular phone, a remote control etc., and more particularly to, a keybutton-equipped device that is easy to assemble and disassemble and that prevents foreign matter from getting into the case.

BACKGROUND OF THE INVENTION

Conventional keybutton-equipped devices typically have a keypad which is mounted inside the case and is provided with keybuttons exposed on the surface and penetrating through holes in the case equipped for the keybuttons.

Japanese utility model application laid-open No. 5-16571 (1993) discloses a keypad structure that switch-button member (keypad) is mounted inside the case and only the buttons are exposed on the surface and penetrating through holes in the case equipped for the buttons. In this structure, it is troublesome to assemble and disassemble the switch-button member.

Also, Japanese patent application laid-open No. 8-148054 (1996) discloses a key structure that switch-button member (keypad) is mounted inside the case, only the buttons are exposed on the surface and penetrating through holes in the case equipped for the buttons, and inside of the case is water-proofed by using covering sheet. In this structure, it is still troublesome to assemble and disassemble the switch-button member. Also, it allows dust or water to get into the case and to be left there. Further, the covering sheet may incur corrosion.

Thus, in the conventional keybutton-equipped devices, there is a problem that it is very troublesome to mount/remove the keypad. Also, they allow some liquid or dust to get into the case from a clearance between the hole in the case and the keybutton.

SUMMARY OF THE INVENTION

Accordingly, it is an object of the invention to provide a keybutton-equipped device with a structure that allows the keypad to be mounted/removed easily and prevents foreign matter from getting into the case.

According to the invention, a keybutton-equipped device, comprises:

a board at a predetermined position on which a predetermined number of sensitive element (e.g., a sensor and switch) at a predetermined position is provided;

a case in which the board is mounted and a predetermined number of hole is formed at a position corresponding to the sensitive element on the board; and a key pad which is of stretchy material (e.g., rubber and plastic) and is formed like a tubular body to cover and tighten the case, the keypad having a predetermined number of keybutton that is formed on the outer surface of the tubular body and at a position corresponding to the sensitive element on the board and gives an impulse (e.g., a physical impulse such as pressure, voltage, current, static electricity and magnetic force) to the sensitive element on the board through the hole in the case when it is pressed down.

DESCRIPTION OF THE DRAWINGS

The invention will be explained in more detail in conjunction with the appended drawings, wherein.

DESCRIPTION OF THE PREFERRED EMBODIMENTS

Figure 1A:
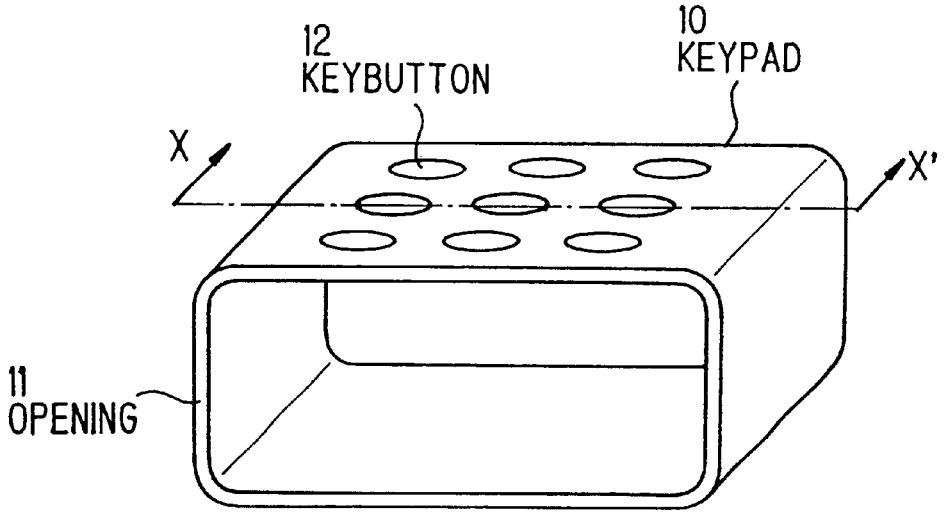
FIG. 1A is a perspective view showing a keypad in a first preferred embodiment according to the invention.
Figure 1B:
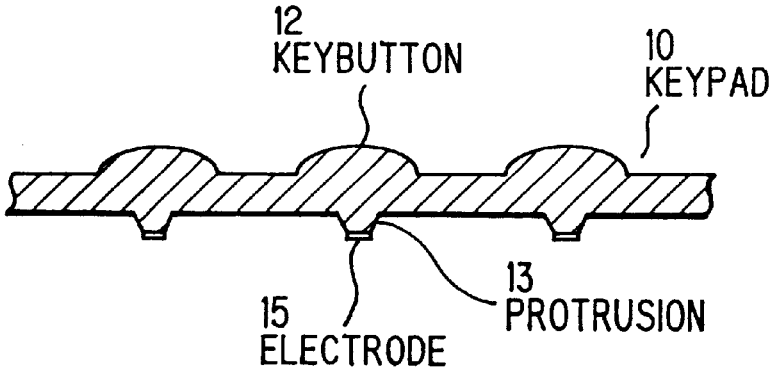
FIG. 1B is a cross sectional view cut along the line X–X' in FIG. 1A.
Figure 2:
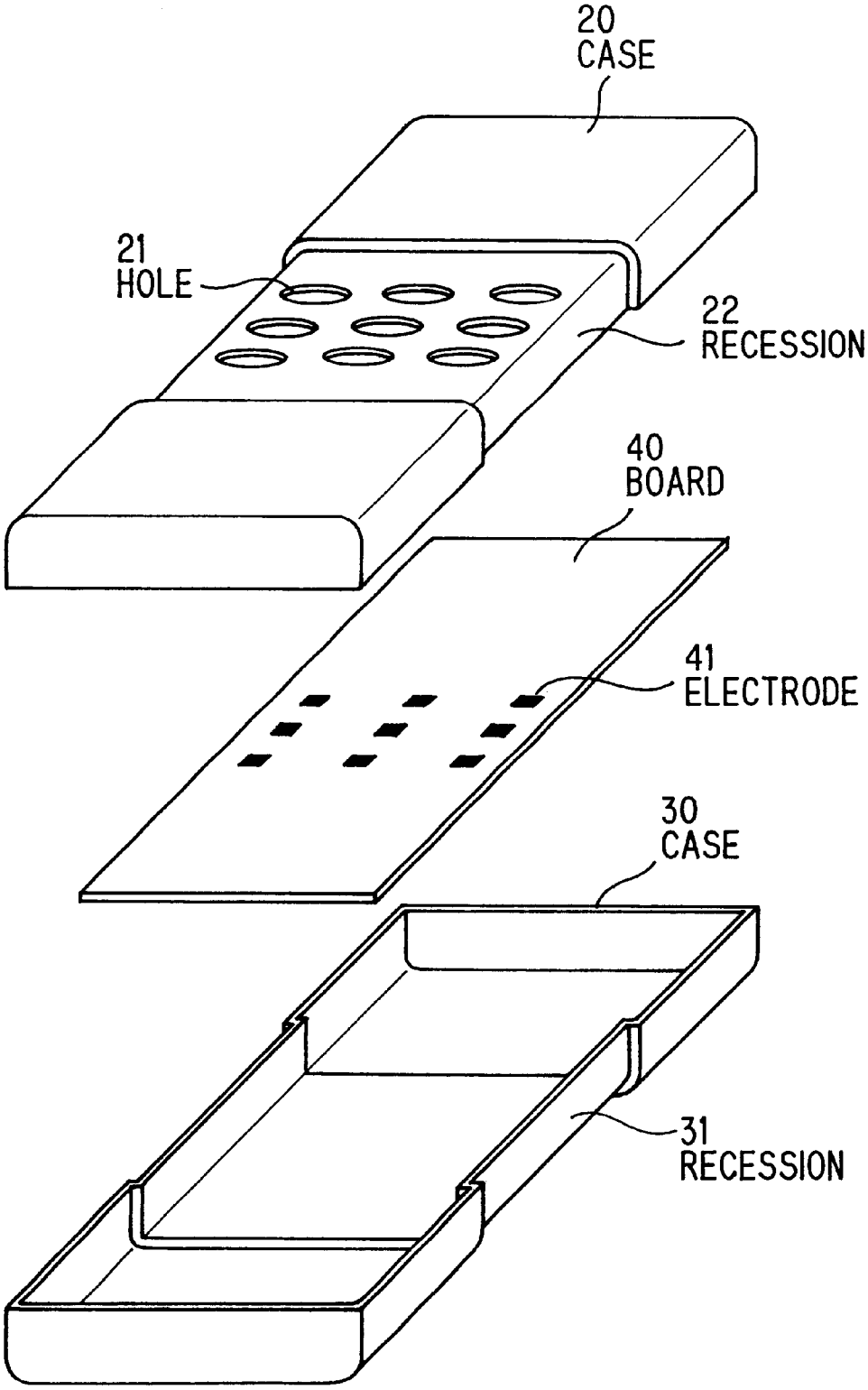
FIG. 2 is a broken perspective view showing a case in the first embodiment of the invention.
Figure 3:
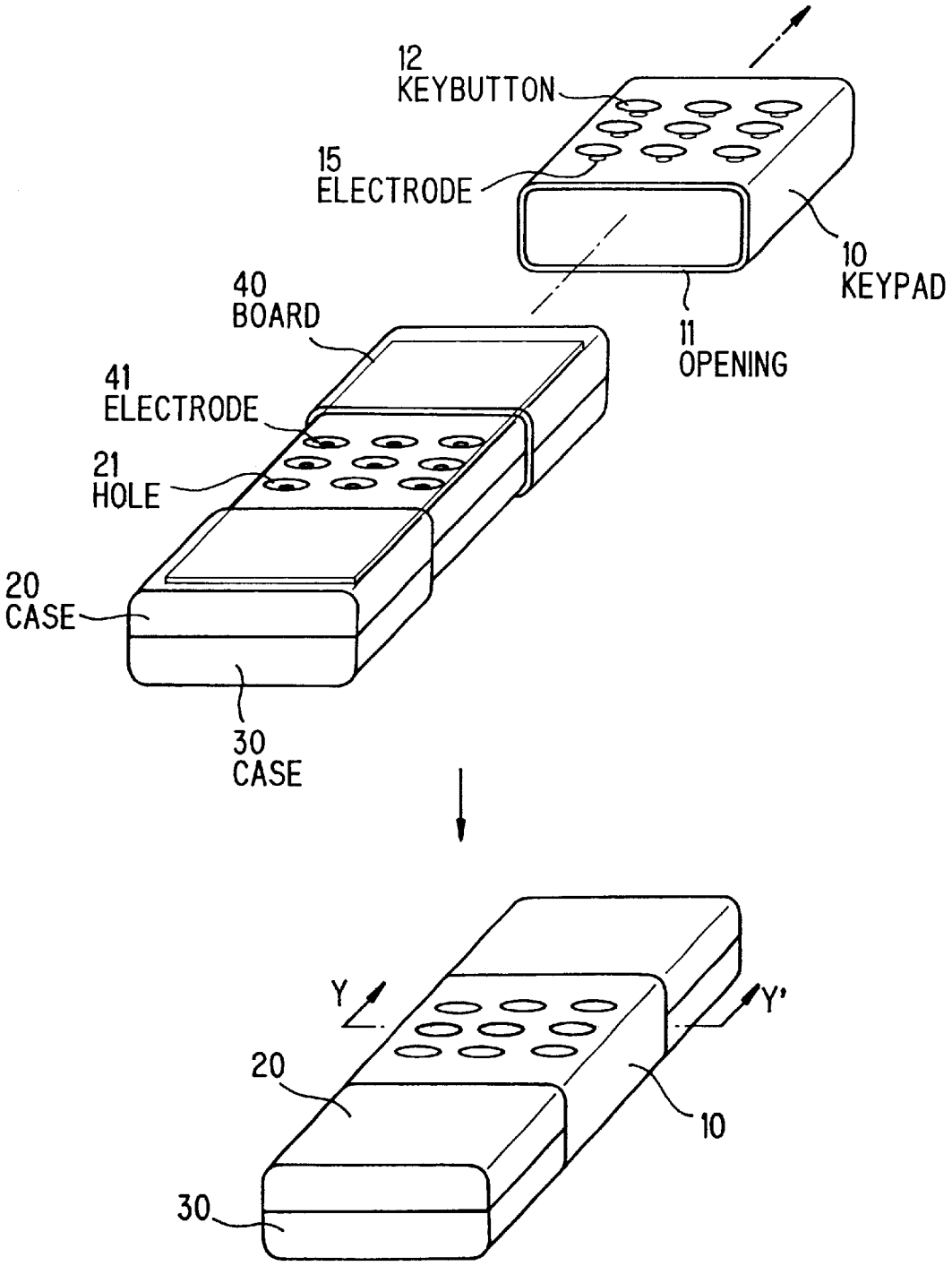
FIG. 3 is a perspective view showing the process of assembling the keypad and the case in the first embodiment of the invention.

A keybutton-equipped device in the first preferred embodiment according to the invention will be explained referring to the drawings. FIG. 1A is a perspective view showing a keypad in the first embodiment of the invention, and FIG. 1B is a cross sectional view cut along the line X–X' in FIG. 1A. FIG. 2 is a broken perspective view showing a case in the first embodiment of the invention. FIG. 3 is a perspective view showing the process of assembling the keypad and the case.

In FIGS. 1A and 1B, the keypad 10 is of stretchy material and formed like a tube. It has a predetermined number of keybuttons 12 on the outer surface of the tubular body which are disposed corresponding to electrodes 41 on a board 40 (see FIG. 2), a predetermined number of protrusions 13 on the inner surface of the tubular body which are disposed corresponding to the keybuttons 12, and a predetermined number of electrodes 15 which are disposed on the top of the protrusions 13 and contact the electrodes 41 on the board 40 through holes 21 in the case 20 (FIG. 2). The keypad 10 is attached being tightly fit onto the case. The keypad 10 is composed of the tubular body, the keybuttons and the protrusions that are integrally formed using stretchy material. Although in FIG. 1A the keypad 10 is provided with an opening 11 that penetrates through the tubular body, it may be so formed that one opening 11 is shut up disposing recessions 22, 31 (see FIG. 2) of the case at the end of the case. Also, the protrusion 13 may be disposed on the inner surface of recessions that are provided on the inner surface of the tubular body.

As shown in FIG. 2, the case is composed of a case member 20 on the operation side, a case member 30 on the hand side and a board 40. The case member 20 on the operation side is provided with the predetermined number of holes 21 at the positions corresponding to the electrodes 15 on the keypad 10, and is provided with the recession 22 that positions the keypad 10 to middle and surrounding part in the longitudinal direction of the case. The case member 30 on the hand side is provided with the recession 31 that positions the keypad 10 to middle and surrounding part in the longitudinal direction of the case, at the position corresponding to the recession 22 of the case member 20 on the operation side. The board 40 is mounted inside both the case member 20 on the operation side and the case member 30 on the hand side. On the operation side of the board 40, there are provided the predetermined number of electrodes 41 at the position corresponding to the holes 21 in the case member 20 on the operation side and the protrusions 13 or electrodes 15 on the keypad l0. The respective electrodes 41 on the board 40 neighbor so that the positive electrode and negative electrode do not contact.

The case (including the board 40) is pushed into the opening 11 of the keypad 10 while expanding it outward. In this process, the keypad 10 is fit onto the recessions 22, 31 in the case while aligning the protrusion 13 of the keypad 10 with the corresponding holes 21 in the case.

The operation of the keybutton-equipped device in the first embodiment is explained below.

Figure 4:
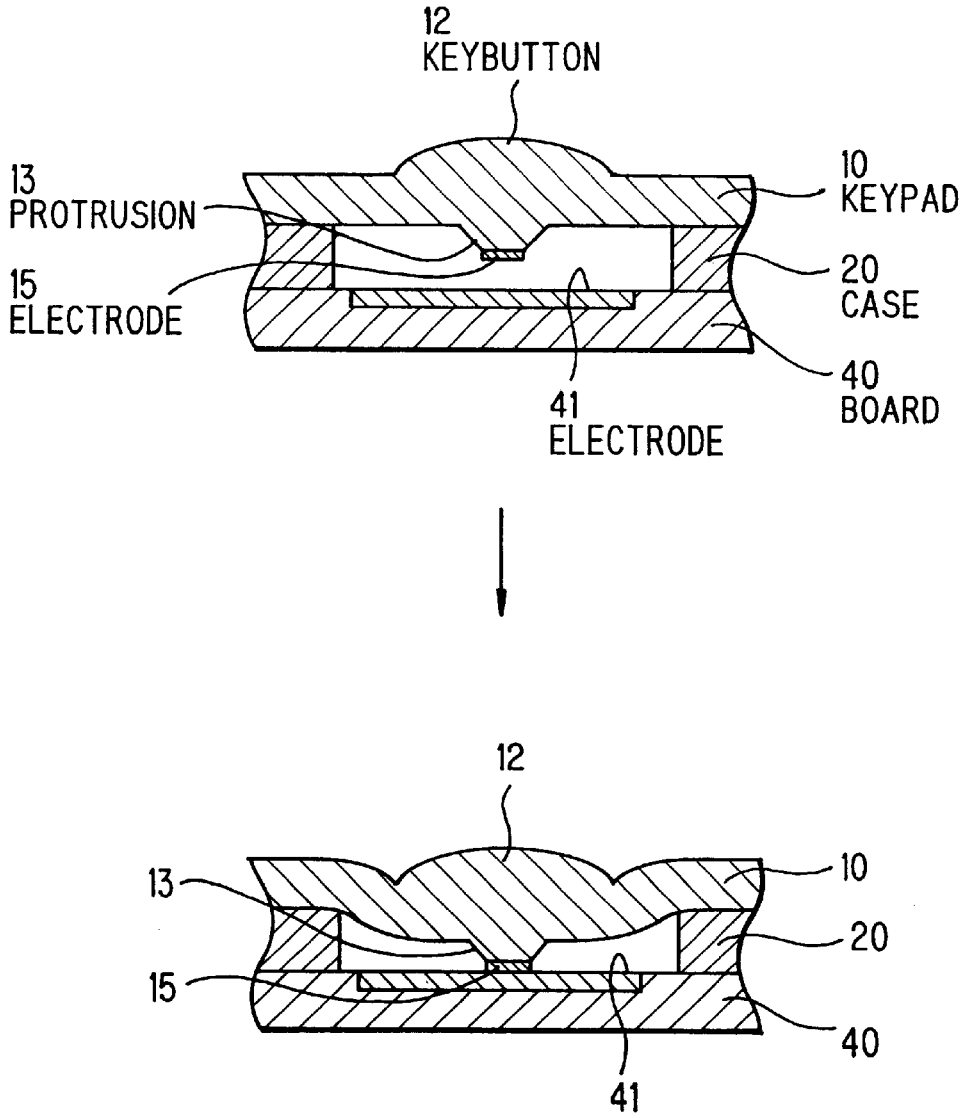
FIG. 4 is part of cross sectional view cut along the line Y–Y' in FIG. 3 to show the contact/separation between electrodes 15 and 41.

FIG. 4 is part of cross sectional view cut along the line Y–Y' in FIG. 3, and shows the contact/separation between the electrodes 15 and 41. When the keybutton 12 is pressed, the electrode 15 on the protrusion 13 on the back surface contacts the electrode 41 on the board 40 to turn on electricity (between the positive electrode and negative electrode). On the other hand, when the keybutton 12 is released, it returns to the initial state before pressing it.

A keybutton-equipped device in the second preferred embodiment according to the invention will be explained below.

Figure 5:
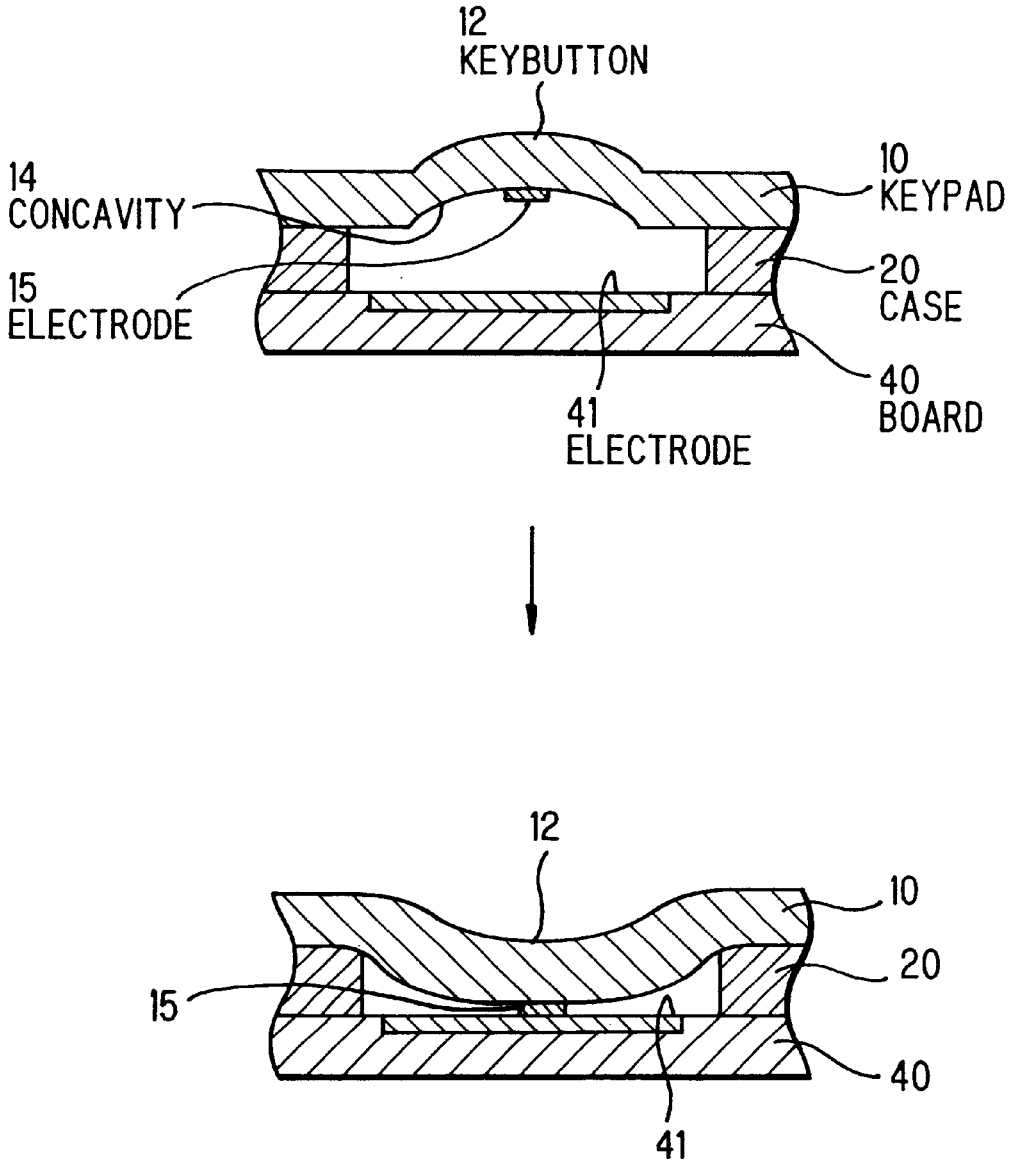
FIG. 5 is a cross sectional view (corresponding to FIG. 4 showing the cross sectional view cut along the line Y–Y' in FIG. 3) showing a keybutton-equipped device with recessions in the keypad in a second preferred embodiment of the invention to show the contact/separation between the electrodes 15 and 41.

FIG. 5 is a cross sectional view (corresponding to FIG. 4 showing the cross sectional view cut along the line Y–Y' in FIG. 3) showing a keybutton-equipped device with recessions in the keypad in the second embodiment of the invention, and shows the contact/separation between the electrodes 15 and 41. In this embodiment, instead of the protrusion 13 of the keypad 10 in the first embodiment, there are provided a predetermined number of the recessions 14 with the electrode 15. The other components are similar to those in the first embodiment. This embodiment is characterized by that the recession 14 turns into a protrusion when the keybutton 12 is pressed. In the assembling or disassembling, it is intended to prevent the protrusion (in the first embodiment) from scratching the case. In operation, when the keybutton 12 is pressed, the pressed part of the keybutton l2 is recessed and the recession 14 turns into a protrusion. Thereby, the electrode 15 that was on the recession 14 is on the top of the protrusion created. Thus, the electrode 15 contacts the electrode 41 on the board 40 to turn on electricity (between the positive electrode and negative electrode). On the other hand, when the keybutton 12 is released, it returns to the initial state before pressing it.

A keybutton-equipped device in the third preferred embodiment according to the invention will be explained below.

Figure 6:
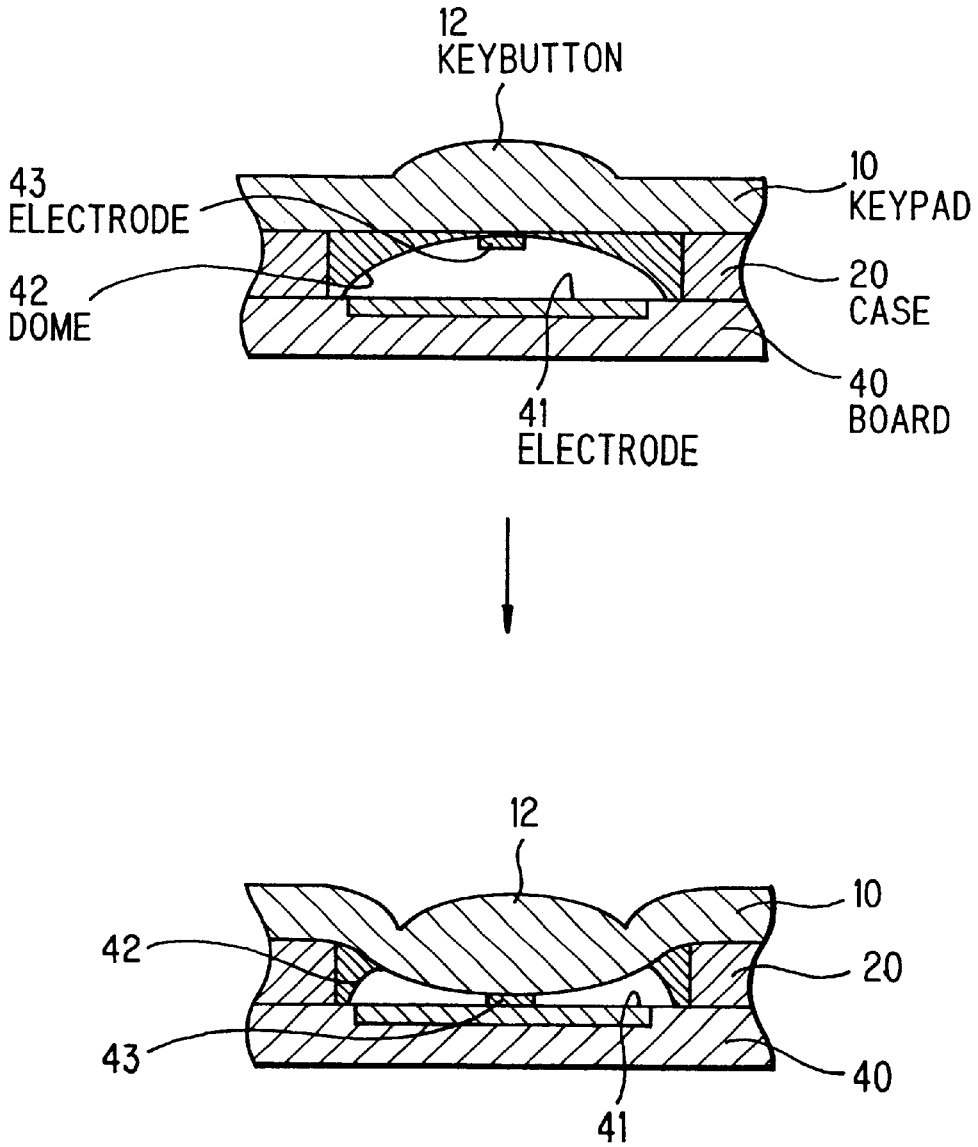
FIG. 6 is a cross sectional view (corresponding to FIG. 4 showing the cross sectional view cut along the line Y–Y' in FIG. 3) showing a keybutton-equipped device with dome switches over the electrodes of the board in a third preferred embodiment of the invention to show the contact/separation between electrodes 43 and 41.

FIG. 6 is a cross sectional view (corresponding to FIG. 4 showing the cross sectional view cut along the line Y–Y' in FIG. 3) showing a keybutton-equipped device with dome switches over the electrodes of the board in the third embodiment of the invention, and shows the contact/separation between electrodes 43 and 41. In this embodiment, instead of the electrode provided on the keypad in the first or second embodiment, there are provided the dome switches that an electrode is disposed on the concave side of a dome 42 which is of elastic material. The other components are similarly provided. This is advantageous in protecting the contacts of electrodes. In operation, when the keybutton 12 is pressed, the back side of the keybutton 12 (which is shown flat in an upper illustration in FIG. 6) presses down the electrode 43 while deforming the dome 42. Thus, the electrode 43 contacts the electrode 41 on the board 40 to turn on electricity (between the positive electrode and negative electrode). On the other hand, when the keybutton 12 is released, the keybutton 12 and the dome 42 return to the initial state before pressing it.

A keybutton-equipped device in the fourth preferred embodiment according to the invention will be explained below.

Figure 7:
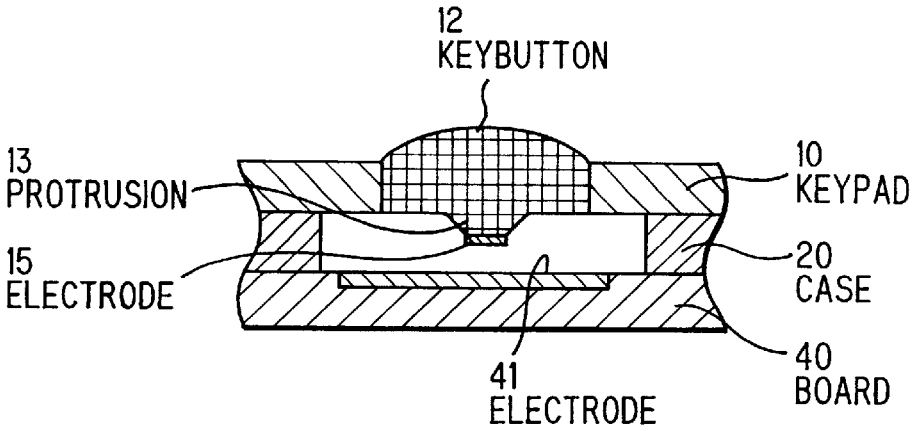
FIG. 7 is a cross sectional view (corresponding to FIG. 4 showing the cross sectional view cut along the line Y–Y' in FIG. 3) showing a keybutton-equipped device with a keybutton of different material in a fourth preferred embodiment of the invention.

FIG. 7 is a cross sectional view (corresponding to FIG. 4 showing the cross sectional view cut along the line Y–Y' in FIG. 3) showing a keybutton-equipped device with a keybutton 12 of different material in the fourth embodiment of the invention. In this embodiment, the keybutton 12 or surrounding part of the keybutton 12 is of different material (e.g., hardmaterial and transparent material) from stretchy material used for the tubular body. The other components are similarly provided. This is helpful in improving the push-down feeling of keybutton or making the keybutton illuminated by providing a illuminant such as LED etc. adjacent to the electrode of the board even when it is dark. The operation is similar to that in the first embodiment (See FIG. 4) . Meanwhile the keybutton 12 is adhered to at the boundary of the tubular body (stretchy material) . The adhering face is not limited to flat, as shown in FIG. 7, at the side of the keybutton 12, and may be uneven to get adhesive power.

Advantages of the Invention

In this invention, the case is tightened by the tubular keypad of stretchy material. Therefore, when removing the keypad, it is not necessary to disassemble the case, thus it is not troublesome. Also, the keypad is easy to assemble.

Also, the case is covered with and tightened by the tubular keypad of stretchy material. Therefore, the structure of the case can be strengthened by the stretching function of the keypad.

Further, since the keypad is attached covering the circumference of the case, there is no gap between the keybutton and the hole in the case that has existed in the conventional devices. Also, the enlarged contact area between the case and the keypad can prevent liquid or dust from getting into the case from outside.

Also, the keybutton and or surrounding part of the keybutton is of different material (e.g., hard material and transparent material) from stretchy material used for the tubular body. This is helpful in improving the push-down feeling of keybutton or making the keybutton illuminated by providing a illuminant such as LED etc. adjacent to the electrode of the board.

Further, in the keypad, the tubular body and the keybutton is formed integrally by conducting only a process of casting them in the lump. Therefore the manufacturing cost can be reduced.

Also, by providing a protrusion at position corresponding to a keybutton on the back side of the keypad, the push-down feeling of keybutton can be improved.

Also, instead of the protrusion on the back side of the keypad, the keybutton-equipped device may be provided with a recession with electrode that turns into a protrusion by pressing the keybutton. This helps assembling and disassembling the keypad since there is no protrusion to cause a friction against the case.

Also, instead of the electrode on the keypad, it may be provided with a dome switch that an electrode is disposed on the concave side of a dome which is of elastic material. This helps protecting the contacts of electrodes since the contacts are hidden by the dome.

Also, the recession provided on the surface of the case to receive the keypad helps making the appearance of device simple.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching here is set forth.

What is claimed is:

1. A keybutton-equipped device, comprising:

a board at a predetermined position on which a predetermined number of sensitive element at a predetermined position is provided;

a case in which said board is mounted and a predetermined number of hole is formed at a position corresponding to said sensitive element on said board; and a keypad which is of stretchy material and is formed like a tubular body, to cover and tighten said case, said keypad having a predetermined number of keybutton that is formed on the outer surface of said tubular body and at a position corresponding to said sensitive element on said board and gives an impulse to said sensitive element on said board through said hole in said case when it is pressed down.

2. A keybutton-equipped device, according to claim 1, wherein:

said keybutton or its surrounding part is of different material from that of said tubular body.

3. A keybutton-equipped device, according to claim 1, wherein:

said keybutton is of hard material.

4. A keybutton-equipped device, according to claim 1, wherein:

said keybutton is of transparent material; and said board is provided with an illuminant adjacent to said sensitive element.

5. A keybutton-equipped device, according to claim 1, wherein:

said tubular body and said keybutton are integrally made of stretchy material.

6. A keybutton-equipped device, according to claim 1, wherein:

said keypad is provided with a predetermined number of protrusion corresponding to said keybutton on the inner surface of said tubular body.

7. A keybutton-equipped device, according to claim 1, wherein:

said keypad is provided with a predetermined number of recession corresponding to said keybutton on the inner surface of said tubular body.

8. A keybutton-equipped device, according to claim 1, wherein:

said sensitive element is a sensor.

9. A keybutton-equipped device, according to claim 1, wherein:

said sensitive element is a pressure-sensitive sensor.

10. A keybutton-equipped device, according to claim 1, wherein:

said sensitive element is a switch.

11. A keybutton-equipped device, according to claim 1, wherein:

said sensitive element is a switch, said switch including an electrode provided on said board and an electrode that is provided corresponding to said keybutton on the inner surface of said keypad and gives an electrical connection/separation when contacting/separating from said electrode on said board.

12. A keybutton-equipped device, according to claim 1, wherein:

said sensitive element is a switch, said switch including an electrode provided on said board and a dome switch that is provided over said board, said dome switch being of elastic material and formed like a dome and having an electrode on its concave surface.

13. A keybutton-equipped device, according to claim 1, wherein:

said case is provided with a recession to receive said keypad on its outer surface.

* * * * *